US008449755B2

(12) United States Patent
Fischer et al.

(10) Patent No.: US 8,449,755 B2
(45) Date of Patent: May 28, 2013

(54) PROCESS FOR THE ANODIC DEHYDRODIMERIZATION OF SUBSTITUTED PHENOLS

(75) Inventors: Andreas Fischer, Heppenheim (DE); Itamar Michael Malkowsky, Hassloch (DE); Florian Stecker, Mannheim (DE); Siegfried Waldvogel, Bonn (DE); Axel Kirste, Swisttal (DE)

(73) Assignee: BASF SE, Ludwigshafen (DE)

( * ) Notice: Subject to any disclaimer, the term of this patent is extended or adjusted under 35 U.S.C. 154(b) by 161 days.

(21) Appl. No.: 13/059,548

(22) PCT Filed: Aug. 28, 2009

(86) PCT No.: PCT/EP2009/061101

§ 371 (c)(1),
(2), (4) Date: Feb. 17, 2011

(87) PCT Pub. No.: WO2010/023258

PCT Pub. Date: Mar. 4, 2010

(65) Prior Publication Data

US 2011/0147228 A1 Jun. 23, 2011

(30) Foreign Application Priority Data

Sep. 1, 2008 (EP) ..... 08163356

(51) Int. Cl.
*C25B 3/10* (2006.01)
*C25B 3/00* (2006.01)

(52) U.S. Cl.
USPC ..... 205/418; 205/419

(58) Field of Classification Search
USPC ..... 205/418, 419
See application file for complete search history.

(56) References Cited

U.S. PATENT DOCUMENTS 4,101,391 A 7/1978 Hallcher ..... 205/59 R

FOREIGN PATENT DOCUMENTS

WO 2005 075709 8/2005
WO WO 2005075709 A2 * 8/2005
WO 2006 077204 7/2006
WO WO 2006077204 A2 * 7/2006

OTHER PUBLICATIONS

McKillop et al., "Thallium in Organic Synthesis. 58. Regiospecific Intermolecular Oxidative Dehydrodimerization of Aromatic Compounds to Biaryls Using Thallium(III) Trifluoroacetate", J. Am. Chem. Soc. (1980), vol. 102, pp. 6504-6512.*
U.S. Appl. No. 13/375,495, filed Dec. 1, 2011, Fischer, et al.
U.S. Appl. No. 13/375,100, filed Nov. 29, 2011, Stecker, et al.
International Search Report issued Jan. 7, 2010 in PCTEP09/061101 filed Aug. 28, 2009.
Guillaume Lessene et al., "Chapter 14: Oxidative Aryl-Coupling Reactions in Synthesis", Modern Arene Chemistry, Wiley-Vch, © 2002, pp. 479-538.
Henning Lund et al., "Chapter 22: Electrolytic Reductive Coupling", Organic Electrochemistry: An Introduction and a Guide, Third Edition, Revised and Expanded, 1991, pp. 885-908.
Itamar M. Malkowsky et al., "Facile and Highly Diastereoselective Formation of a Novel Pentacyclic Scaffold by Direct Anodic Oxidation of 2,4-Dimethylphenol", Eur. J. Org. Chem., 2006, pp. 241-245.
Itamar M. Malkowsky et al., "Facile and Reliable Synthesis of Tetraphenoxyborates and Their Properties", Eur. J. Inorg. Chem., 2006, pp. 1690-1697.
Itamar M. Malkowsky et al., "Novel Template-Directed Anodic Phenol-Coupling Reaction", Chem. Eur. J., 2006, vol. 12, pp. 7482-7488.
Itamar M. Malkowsky et al., "Unexpected Highly Chemoselective Anodic *ortho*-Coupling Reaction of 2,4-Dimethylphenol on Boron-Doped Diamond Electrodes", Eur. J. Org. Chem., 2006, pp. 4569-4572.
A. Kirste, et al. "Highly Selective Electrosynthesis of Biphenols on Graphite Electrodes in Fluorinated Media", Chem. Eur. J., 17, pp. 14164-14169. (2011).
A. Kirste, et al. "*ortho*-Selective Phenol-Coupling Reaction by Anodic Treatment on Boron-Doped Diamond Electrode using Fluorinated Alcohols", Chem. Eur. J., 15, pp. 2273-2277. (2009).

* cited by examiner

*Primary Examiner* — Edna Wong
(74) *Attorney, Agent, or Firm* — Oblon, Spivak, McClelland, Maier & Neustadt, L.L.P.

(57) ABSTRACT

The invention relates to a process for preparing biaryl alcohols, in which anodic dehydrodimerization of substituted phenols is carried out in the presence of partially fluorinated and/or periluorinated mediators and a supporting electrolyte at a graphite electrode.

19 Claims, No Drawings

PROCESS FOR THE ANODIC DEHYDRODIMERIZATION OF SUBSTITUTED PHENOLS

CROSS-REFERENCE TO RELATED APPLICATIONS

The present application is a national stage entry of international application PCT/EP2009/061101 having a filing date of Aug. 28, 2009.

The invention relates to a process for preparing biaryl alcohols, in which anodic dehydrodimerization of substituted phenols is carried out in the presence of partially fluorinated and/or perfluorinated mediators and a supporting electrolyte at a graphite electrode.

The process of the invention enables very inexpensive electrode materials, undivided cell structures and solvent-free processes to be employed. As mediators, it is possible to use, for example, 1,1,1,3,3,3-hexafluoroisopropanol or the significantly cheaper trifluoroacetic acid.

The work-up and isolation of the desired biphenols is very simple.

Biaryls as such are known and are prepared and used industrially. Compounds of this class are, inter alia, of very great interest as backbones for ligands for stereoselective transformations. One possible route to this class of substances is the electrochemical oxidative dimerization of phenols, but this proceeds unselectively in the electrolytes known to those skilled in the art. As an alternative to electrochemical dimerization of phenols, iron(III) salts or other strong oxidants are used.

In Modern Arene Chemistry, Ed: D. Astruc, VCH-Wiley, Weinheim 2002, pages 479-538, G. Lessene and K. S. Feldman state that this transformation can in some cases also be achieved under aerobic conditions in the presence of transition metal catalysts. A disadvantage of this synthesis is the use of iron chloride since this leads to numerous by-products. Furthermore, only strongly activated compounds can be reacted under these aerobic conditions.

Particularly advantageous and therefore frequently used substrates have fused benzene rings or bulky alkyl groups. An example which may be mentioned here is 2,2'-dihydroxy-1,1'-binaphthyl (BINOL) which is prepared from 2-naphthol.

If an attempt is made to subject 2,4-dimethylphenol (1) to an oxidative coupling in a manner analogous to the textbook methods of C. E. Rommel, Staatsexamensarbeit, Münster 2002 and generally of H. Lund, M. M. Baizer, Organic Electrochemistry: An Introduction and a Guide, 3rd edition, Marcel Dekker, New York 1991, Chapter 22.III, 885-908, a derivative of Pummer's ketone (3) rather than the desired ortho,ortho-coupled product 2 is usually obtained as main product. The formation of the tricyclic framework 3 is known for para-alkyl-substituted phenols and likewise occurs in the synthesis of many natural materials.

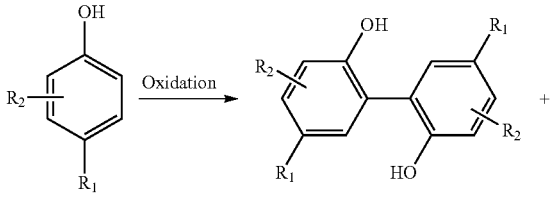

1 2

-continued

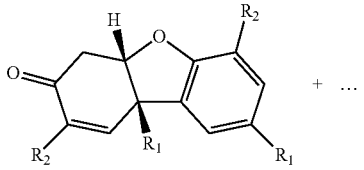

Derivative of Pummer's ketone

3

The anodic synthesis of biphenols, specifically of 3,3',5,5'-tetramethyl-2,2'-biphenol (2), using various electrochemical methods has been studied intensively for some years. A strong preference for the formation of the derivative of Pummer's ketone (3) is likewise found in the direct reaction in a wide variety of electrolyte systems. The desired dehydrodimer 2 was isolated in a yield of only 3-7%. In Eur. J. Org. Chem. 2006, 241-245, I. M. Malkowsky, C. E. Rommel, K. Wedeking, R. Fröhlich, K. Bergander, M. Nieger, C. Quaiser, U. Griesbach, H. Pütter and S. R. Waldvogel describe the formation of further pentacyclic frameworks which have not previously been described. Further studies showed that free phenoxyl radicals are responsible for the formation of Pummer's ketone. To achieve targeted coupling in the ortho positions, a boron template was developed, as described by I. M. Malkowsky, R. Fröhlich, U. Griesbach, H. Pütter and S. R. Waldvogel in Eur. J. Inorg. Chem. 2006, 1690-1697 and by I. M. Malkowsky, U. Griesbach, H. Pütter and S. R. Waldvogel in Chem. Eur. J. 2006, 12, 7482-7488. As described by C. Rommel, I. M. Malkowsky, S. R. Waldvogel, H. Pütter and U. Griesbach in WO-A 2005/075709, the electrochemical reaction of this multistage sequence proceeds successfully for a relatively wide range of substrates and also on a relatively large scale. An additional disadvantage apart from the high preparative complexity was the use of acetonitrile in the electrolyte.

The use of boron-doped diamond electrodes (BDD) enabled a direct anodic reaction to be found for 2,4-dimethylphenol as sole substrate, as described by I. M. Malkowsky, U. Griesbach, H. Pütter and S. R. Waldvogel in Eur. J. Org. Chem. 2006, 4569-4572; and M. Malkowsky, S. R. Waldvogel, H. Pütter and U. Griesbach in WO-A 2006/077204. The ratio of biphenol to Pummer's ketone is usually better than 18:1. To avoid electrochemical combustion at the BDD anode, the coupling of the phenol is carried out only to a conversion of about 30%. Additional disadvantages of this process are the low stability of the BDD electrodes, their price and the small range of substrates.

It is an object of the present invention to provide a process by means of which the oxidative coupling of substituted phenols occurs selectively and efficiently without the need to work in the presence of expensive electrode material. The coupling of substituted phenols should preferably occur in the ortho position.

This object is achieved by a process for preparing biaryl alcohols, wherein substituted aryl alcohols are anodically dehydrodimerized in the presence of partially fluorinated and/or perfluorinated mediators and at least one supporting electrolyte by means of a graphite electrode.

The process of the invention is advantageous when the OH group of the substituted aryl alcohols used is located directly on the aromatic.

The process of the invention is advantageous when the substituted aryl alcohols used are identical.

The process of the invention is advantageous when the substituted aryl alcohols used can be monocyclic or polycyclic.

The process of the invention is advantageous when the dimerization takes place in the ortho position relative to the alcohol group of the substituted aryl alcohols.

The process of the invention is advantageous when the mediators used are partially fluorinated and/or perfluorinated alcohols and/or acids.

The process of the invention is advantageous when 1,1,1,3,3,3-hexafluoroisopropanol or trifluoroacetic acid is used as mediator.

The process of the invention is advantageous when supporting electrolytes selected from the group consisting of alkali metal, alkaline earth metal, tetra($C_1$-$C_6$-alkyl)-ammonium salts are used as supporting electrolytes.

The process of the invention is advantageous when the counterions of the supporting electrolytes are selected from the group consisting of sulfate, hydrogensulfate, alkylsulfates, arylsulfates, halides, phosphates, carbonates, alkylphosphates, alkylcarbonates, nitrate, alkoxides, tetrafluoroborate, hexafluorophosphate and perchlorate.

The process of the invention is advantageous when no further solvent is used for the electrolysis.

The process of the invention is advantageous when a flow cell is used for the electrolysis.

The process of the invention is advantageous when current densities of from 1 to 1000 mA/cm$^2$ are used.

The process of the invention is advantageous when the electrolysis is carried out at temperatures in the range from −20 to 60° C. and atmospheric pressure.

The process of the invention is advantageous when 2,4-dimethylphenol is used as aryl alcohol.

For the purposes of the present invention, aryl alcohols are aromatic alcohols in which the hydroxyl group is bound directly to the aromatic ring.

The aromatic on which the aryl alcohol is based can be monocyclic or polycyclic. The aromatic is preferably monocyclic (phenol derivatives) or bicyclic (naphthol derivatives), in particular monocyclic. The aryl alcohols can also bear further substituents. These substituents are selected independently from the group consisting of $C_1$-$C_{10}$-alkyl groups, halogens, $C_1$-$C_{10}$-alkoxy groups, alkylene or arylene radicals interrupted by oxygen or sulfur, $C_1$-$C_{10}$-alkoxycarboxyl, nitrile, nitro and $C_1$-$C_{10}$-alkoxycarbamoyl, particularly preferably methyl, ethyl, n-propyl, isopropyl, n-butyl, trifluoromethyl, fluorine, chlorine, bromine, iodine, methoxy, ethoxy, methylene, ethylene, propylene, isopropylene, benzylidene, nitrile, nitro, very particularly preferably methyl, methoxy, methylene, ethylene, trifluoromethyl, fluorine and bromine. The novel process enables a wide range of aryl alcohols to be used. Particular preference is given to electron-rich arenes such as phenol and monosubstituted or polysubstituted phenols and also naphthol (α- and β-) and substituted derivatives thereof, with very particular preference being given to phenols and especially preferably 4-alkyl- and 2,4-dialkyl-substituted phenols.

Suitable substrates for the electrodimerization according to the present invention are in principle all aryl alcohols as long as their three-dimensional structure and stearic demands allow dimerization to take place. The aryl alcohols can be monocyclic, bicyclic, tricyclic or higher-cyclic. They are preferably monocyclic or bicyclic, in particular monocyclic. Furthermore, the aryl alcohols preferably have one OH function.

Examples of suitable aryl alcohols comprise phenol and monosubstituted and polysubstituted phenols represented by the formula (I) below, in which the radicals R1 to R4 are identical or different and are selected independently from among the following substituents: H, $C_1$-$C_{10}$-alkyl, $C_1$-$C_{10}$-alkoxy, halogen, $C_1$-$C_{10}$-alkoxycarboxyl, nitrile and mono- and di-$C_1$-$C_{10}$-alkoxycarbamoyl.

I

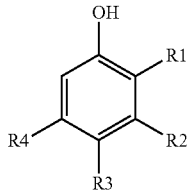

Further examples comprise naphthol (α- and β-) and substituted derivatives thereof as per the formulae (II) and (III) below, in which the radicals R1 to R7 are identical or different and are selected from among the following substituents: H, $C_1$-$C_{10}$-alkyl, $C_1$-$C_{10}$-alkoxy, halogen, $C_1$-$C_{10}$-alkoxycarboxyl, nitrile and mono- and di-$C_1$-$C_{10}$-alkoxy-carbamoyl.

II

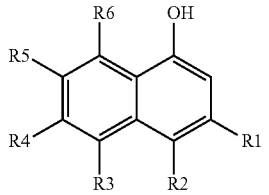

III

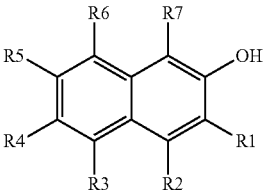

After the reaction is complete, the electrolyte solution is worked up by general separation methods. For this purpose, the electrolyte solution is generally firstly distilled and the individual compounds are obtained separately in the form of various fractions. Further purification can be carried out, for example, by crystallization, distillation, sublimation or chromatography.

The preparation of the biaryl alcohol is carried out electrolytically, with the corresponding aryl alcohol being anodically oxidized. The process of the invention will hereinafter be referred to as electrodimerization. It has surprisingly been found that the biaryl alcohols are formed selectively and in a high yield by means of the process of the invention using mediators. Furthermore, it has been found that the process of the invention makes it possible to employ very inexpensive electrode materials, undivided cell structures and solvent-free processes.

The work-up and isolation of the desired biphenols is very simple. After the reaction is complete, the electrolyte solution is worked up by general separation methods. For this purpose, the electrolyte solution is generally firstly distilled and the individual compounds are obtained separately in the form of various fractions. Further purification can be carried out, for example, by crystallization, distillation, sublimation or chromatography.

In the process of the invention, partially fluorinated and/or perfluorinated alcohols and/or acids, preferably perfluorinated alcohols and carboxylic acids, very particularly preferably 1,1,1,3,3,3-hexafluoroisopropanol or trifluoroacetic acid, are used as mediators.

No further solvents are necessary in the electrolyte.

The corresponding products can be obtained in NMR-pure form by short path distillation and precipitation.

The electrolysis is carried out in the conventional electrolysis cells known to those skilled in the art. Suitable electrolysis cells are known to those skilled in the art. The electrolysis is preferably carried out continuously in undivided flow cells or batchwise in glass beaker cells.

Very particularly useful cells are bipolar capillary cells or stacked plate cells in which the electrodes are configured as plates and are arranged in parallel, as described in Ullmann's Encyclopedia of Industrial Chemistry, 1999 electronic release, Sixth Edition, VCH-Weinheim, Volumne and in Electrochemistry, Chapter 3.5. special cell designs and also Chapter 5, Organic Electrochemistry, Subchapter 5.4.3.2 Cell Design.

The current densities at which the process is carried out are generally 1-1000 mA/cm$^2$, preferably 5-100 mA/cm$^2$. The temperatures are usually from −20 to 60° C., preferably from 10 to 60° C. The process is generally carried out at atmospheric pressure. Higher pressures are preferably employed when the process is to be carried out at relatively high temperatures in order to avoid boiling of the starting compounds or cosolvents or mediators.

Suitable anode materials are, for example, noble metals such as platinum or metal oxides such as ruthenium or chromium oxide or mixed oxides of the type $RuO_xTiO_x$ and also diamond electrodes. Preference is given to graphite or carbon electrodes. Possible cathode materials are, for example, iron, steel, stainless steel, nickel or noble metals such as platinum and also graphite or carbon materials and also diamond electrodes. Preference is given to the system graphite as anode and cathode, graphite as anode and nickel, stainless steel or steel as cathode and also platinum as anode and cathode.

To carry out the electrolysis, the aryl alcohol compound is dissolved in a suitable solvent. The customary solvents known to those skilled in the art, preferably solvents from the group consisting of polar protic and polar aprotic solvents, are suitable. Particular preference is given to the aryl alcohol compound itself serving as solvent and reagent.

Examples of polar aprotic solvents comprise nitriles, amides, carbonates, ethers, ureas, chlorinated hydrocarbons.

Examples of particularly preferred polar aprotic solvents comprise acetonitrile, dimethylformamide, dimethyl sulfoxide, propylene carbonate and dichloromethane. Examples of polar protic solvents comprise alcohols, carboxylic acids and amides. Examples of particularly preferred polar protic solvents comprise methanol, ethanol, propanol, butanol, pentanol and hexanol. These can also be partially halogenated or perhalogenated, e.g. 1,1,1,3,3,3-hexafluoroisopropanol (HFIP) or trifluoroacetic acid (TFA).

If appropriate, customary cosolvents are added to the electrolysis solution. These are the inert solvents having a high oxidation potential which are customary in organic chemistry. Examples which may be mentioned are dimethyl carbonate, propylene carbonate, tetrahydrofuran, dimethoxyethane, acetonitrile or dimethylformamide. Supporting electrolytes comprised in the electrolysis solution are generally alkaline metal, alkaline earth metal, tetra($C_1$-$C_6$-alkyl)ammonium, preferably tri($C_1$-$C_6$-alkyl)-methylammonium, salts. Possible counterions are sulfate, hydrogensulfate, alkylsulfates, arylsulfates, halides, phosphates, carbonates, alkylphosphates, alkylcarbonates, nitrate, alkoxides, tetrafluoroborate, hexafluorophosphate or perchlorate.

The acids derived from the abovementioned anions are also possible as supporting electrolytes.

Preference is given to methyltributylammonium methylsulfate (MTBS), methyltriethylammonium methylsulfate (MTES), methyltripropylmethylammonium methylsulfate or tetrabutylammonium tetrafluoroborate (TBABF).

EXAMPLES

Tables with Reactions

TABLE 1

Reaction of 2,4-dimethylphenol at graphite using HFIP[a]

| Electrolyte | T [° C.] | $U_{max}$ [V] | F [1/mol] | j [mA/cm$^2$] | $Y^{ISTD}$ [%][b] | SY [%][b] | $Y^{isolated}$ [%][b] | Recovered phenol [g] |
|---|---|---|---|---|---|---|---|---|
| 15.9 g of phenol/1 g of MTES/9 ml of HFIP | 30 | 27 | 1.00 | 20 | 66 | 53 | | 3.09 |
| 15.9 g of phenol/1 g of MTES/9 ml of HFIP | 30 | 22 | 0.77 | 20 | 51 | 49 | | 4.03 |
| 15.9 g of phenol/1 g of MTES/9 ml of HFIP | 30 | 17 | 0.77 | 10 | 66 | 50 | 55[d] | 6.60 |
| 15.9 g of phenol/3 g of MTES/9 ml of HFIP | 30 | 8 | 0.77 | 10 | 47 | 35 | | 6.91 |
| 15.9 g of phenol/5 g of MTES/9 ml of HFIP | 30 | 10 | 0.77 | 10 | 53 | 38 | | 6.40 |
| 15.9 g of phenol/1 g of a/9 ml of HFIP | 30 | 17 | 0.77 | 10 | 54 | 54 | | 6.08 |
| 15.9 g of phenol/1 g of MTES/9 ml of HFIP | 30 | 13 | 0.77 | 5 | 49 | 35 | 49[c] | 6.93 |
| 15.9 g of phenol/1 g of MTES/4 ml of HFIP | 30 | 21 | 0.77 | 10 | 49 | 36 | | 6.95 |

HFIP: 1,1,1,3,3,3-Hexafluoroisopropanol

TABLE 2

Reaction of 2,4-dimethylphenol at graphite using carboxylic acids

| Electrolyte | T [° C.] | $U_{max}$ [V] | F [1/mol] | j [mA/cm$^2$] | $Y^{ISTD}$ [%][b] | SY [%][b] | $Y^{isolated}$ [%][b,d] | Recovered phenol [g] |
|---|---|---|---|---|---|---|---|---|
| 15.9 g of phenol/1 g of MTES/9 ml of TFA | 30 | 28 | 0.77 | 10 | 41 | 33 | 41 | 6.19 |
| 15.9 g phenol/1 g of MTES/9 ml of TFA | 30 | 16 | 0.77 | 10 | 53 | 50 | 50 | 4.38 |
| 15.9 g of phenol/1 g of MTES/9 ml of TFA | 30 | 15 | 0.77 | 10 | 58 | 51 | 53 | 5.12 |
| 15.9 g of phenol/1 g of MTES/9 ml of TFA | 30 | 18 | 0.77 | 10 | 67 | 55 | 64 | 5.89 |
| 15.9 g of phenol/1 g of MTES/9 ml of AcOH | 30 | 35 | 0.77 | 10 | 25 | 17 | | 7.62 |
| 15.9 g of phenol/1 g of MTES/9 ml of hepta-fluorobutyric acid | 50 | 35 | 0.77 | 10 | | | | |

TFA: Trifluoroacetic acid;
AcOH: acetic acid;
phenol: 2,4-dimethylphenol;
MTES: methyltriethylammonium methylsulfate

TABLE 3

Reaction of 2-bromo-4-methylphenol at graphite

| Electrolyte | T [° C.] | $U_{max}$ [V] | F per mol | j [mA/cm$^2$] | $Y^{ISTD}$ [%][b] | SY [%][b] | $Y^{isolated}$ [%][b,d] | Recovered phenol [g] |
|---|---|---|---|---|---|---|---|---|
| 20.02 g of phenol/1 g of MTES/9 ml of HFIP | 30 | 14 | 0.77 | 10 | 54 | 24 | 36 | 13.25 |
| 20.02 g of phenol/1 g of MTES/9 ml of TFA | 30 | 22 | 0.77 | 10 | 73 | 51 | 76 | 9.08 |

Phenol: 2-Bromo-4-methylphenol;
[a]N,N-Dimethylpyrrolidinium methylsulfate;
[b]Yield taking into account the recovered phenol;
[c]Isolation by crystallization from toluene and chromatrography;
[d]Isolation by crystallization from $^i$PrOH: water and chromatography.

Example 1

Anodic Oxidation of 2,4-Dimethylphenol at Graphite Electrodes Using Trifluoroacetic Acid

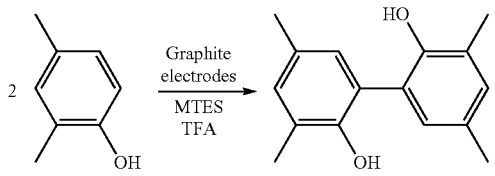

The electrolyte comprising 15.90 g (0.1301 mol, 53% by weight) of 2,4-dimethylphenol, 1.00 g (4.4 mmol, 3% by weight) of methyltriethylammonium methylsulfate and 9 ml (44% by weight) of trifluoroacetic acid is placed in an undivided standard electrolysis cell having a graphite anode and cathode (A=9 cm$^2$). Electrolysis is carried out under galvanostatic conditions at 30° C. and a current density of 10 mA/cm$^2$. 9669 C (0.77 F/mol) are introduced at a maximum applied voltage of 18 V. After the reaction is complete, the electrolyte is transferred by means of toluene to a flask and trifluoroacetic acid and toluene are subsequently removed by distillation at ambient pressure. 5.89 g of excess phenol are subsequently recovered by short path distillation at $4.5\times10^{-3}$ mbar. The reaction residue is taken up in 30 ml of aqueous isopropanol ($^i$PrOH:$H_2O$=4:1). Storage overnight at 4° C. leads to crystallization of the product which is obtained (4.24 g) by filtration and washing with a little cold n-heptane. Further product (2.15 g) can be isolated from the filtrate by chromatographic purification on a short silica gel column (CH:EE=98:2). A total of 6.39 g (0.026 mol, 64%), taking excess phenol into account in the yield, of light-reddish, crystalline product are obtained.

Melting point: 133° C.; $R_F$ (CH:EE=95:5): 0.33; $^1$H-NMR (400 MHz, $CDCl_3$): δ=2.29 (s, 12H, $CH_3$), 4.84 (s, 2H, OH), 6.88 (s, 2H, 4-H), 7.01 (s, 2H, 6-H); $^{13}$C-NMR (100 MHz, $CDCl_3$): δ=16.15 (3-$CH_3$), 20.41 (5-$CH_3$), 122.23 (C-1), 125.17 (C-3), 128.51 (C-6), 129.98 (C-5), 131.97 (C-4), 149.13 (C-2); HRMS: m/e for $[C_{16}H_{19}O_2]^+$ calculated 243.1380, found 243.1389; MS (ESI+): m/e (%): 243.1 (100) $[C_{16}H_{19}O_2]^+$.

Example 2

Anodic Oxidation of 2-Bromo-4-Methylphenol at Graphite Electrodes

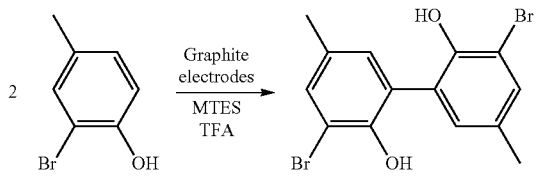

The electrolyte comprising 20.02 g (0.107 mol, 53% by weight) of 2-bromo-4-methylphenol, 1.00 g (4.4 mmol, 3% by weight) of methyltriethylammonium methylsulfate and 11 ml (44% by weight) of trifluoroacetic acid is placed in an undivided standard electrolysis cell having a graphite anode and cathode (A=9 $cm^2$). Electrolysis is carried out under galvanostatic conditions at 30° C. and a current density of 10 $mA/cm^2$. 7950 C (0.77 F/mol) are introduced at a maximum applied voltage of 22V. After the reaction is complete, the electrolyte is transferred by means of toluene to a flask and trifluoroacetic acid and toluene are subsequently removed by distillation at ambient pressure. 9.08 g of excess phenol are subsequently recovered by means of short path distillation at $5.0\times10^{-3}$ mbar. The reaction residue is taken up in 30 ml of aqueous isopropanol ($^i$PrOH:$H_2O$=4:1). Storage overnight at 4° C. leads to crystallization of the product. This is taken up in a little MTBE and filtered through Celite. Pure product (1.35 g) is obtained by removal of the solvent. Further product (6.90 g) can be isolated from the filtrate by chromatographic purification on a silica gel column (CH:EE=95:5). A total of 8.25 g (0.022 mol, 76%), with excess phenol being taken into account in the yield, of colorless, crystalline product are obtained.

Melting point: 144-145° C.; $R_F$ (CH:EE=95:5): 0.06; $^1$H-NMR (300 MHz, $CDCl_3$): δ=2.31 (s, 6H, $CH_3$), 5.80 (s, 2H, OH), 6.88 (d, $^4J_{H,H}$=2.1 Hz, 2H, 6-H), 7.01 (d, $^4J_{H,H}$=2.1 Hz, 2H, 4-H); $^{13}$C-NMR (75 MHz, $CDCl_3$): δ=20.24 (5-$CH_3$), 110.94 (C-3), 125.33 (C-1), 131.44 (C-5), 131.60 (C-6), 132.58 (C-4), 147.11 (C-2).

Example 3

Anodic Oxidation of 2,4-Dimethylphenol at Graphite Electrodes Using HFIP

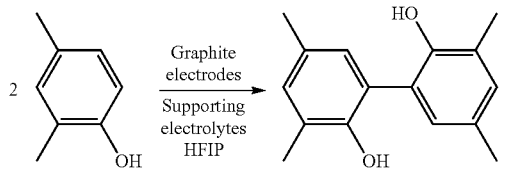

The electrolyte comprising 15.98 g (0.1308 mol, 52% by weight) of 2,4-dimethylphenol, 1.00 g (4.4 mmol, 1% by weight) of methyltriethylammonium methylsulfate and 9 ml (47% by weight) of hexafluoroisopropanol is placed in an undivided standard electrolysis cell having a graphite anode and cathode (A=9 $cm^2$). Electrolysis is carried out under galvanostatic conditions at 30° C. and a current density of 10 $mA/cm^2$. 9721 C (0.77 F/mol) are introduced at a maximum applied voltage of 12.8 V. After the reaction is complete, the solvent is firstly removed and excess phenol is subsequently recovered by means of short path distillation. The reaction residue is taken up in 50 ml of water and 30 ml of TBME, the phases are separated and the aqueous phase is extracted again with 3×30 ml of TBME. The combined organic phases are washed with 50 ml of water and 50 ml of saturated sodium chloride solution, dried over magnesium sulfate and the solvent is removed under reduced pressure. The crude product is dissolved in 10 ml of toluene at 50° C. Slow addition of n-heptane results in crystallization of the product which is obtained by filtration and washing with a little cold n-heptane. Further product can be isolated from the filtrate by chromatographic purification on a silica gel column (CH:EE=98:2, then 95:5). A total of 4.43 g (0.018 mol, 28%) of colorless, crystalline product are obtained.

Melting point: 135-136° C.; $R_F$ (CH:EE=95:5): 0.33; $^1$H-NMR (300 MHz, $CDCl_3$): δ=2.29 (s, 12H, $CH_3$), 5.01 (s, 2H, OH), 6.88 (s, 2H, 4-H), 7.01(s, 2H, 6-H); $^{13}$C-NMR (75 MHz, $CDCl_3$): δ=16.14 (3-$CH_3$), 20.41 (5-$CH_3$), 122.17 (C-1), 125.16 (C-3), 128.49 (C-6), 130.00 (C-5), 132.00 (C-4), 149.13 (C-2).

The invention claimed is:

1. A process for preparing at least one biaryl alcohol, the process comprising:

anodically dehydrodimerizing at least one substituted aryl alcohol in the presence of at least one mediator selected from the group consisting of a partially fluorinated mediator and a perfluorinated mediator, and at least one supporting electrolyte, with a graphite electrode, wherein the OH group of the at least one substituted aryl alcohol reacted is bound directly to an aromatic ring of the at least one substituted aryl alcohol.

2. The process of claim 1, wherein the at least one substituted aryl alcohol is identical.

3. The process of claim 2, wherein the at least one substituted aryl alcohol is monocyclic.

4. The process of claim 2, wherein the at least one substituted aryl alcohol is polycyclic.

5. The process of claim 1, wherein the at least one substituted aryl alcohol is monocyclic.

6. The process of claim 1, wherein the dehydrodimerizing takes place in an ortho position relative to the alcohol group of the at least one substituted aryl alcohol.

7. The process of claim 1, wherein the at least one mediator is selected from the group consisting of a partially fluorinated alcohol, a perfluorinated alcohol, a partially fluorinated acid, and a perfluorinated acid.

8. The process of claim 1, wherein 1,1,1,3,3,3-hexafluoroisopropanol is the at least one mediator.

9. The process of claim 1, wherein the at least one supporting electrolyte is selected from the group consisting of an alkali metal salt, an alkaline earth metal salt, and a tetra($C_1$-$C_6$-alkyl)ammonium salt.

10. The process of claim 1, wherein a counterion of the at least one supporting electrolyte is at least one selected from the group consisting of sulfate, hydrogensulfate, an alkylsulfate, an arylsulfate, a halide, a phosphate, a carbonate, alkylphosphate, alkylcarbonate, nitrate, an alkoxide, tetrafluoroborate, hexafluorophosphate, and perchlorate.

11. The process of claim 1, wherein no solvent is employed for the dehydrodimerizing.

12. The process of claim 1, wherein the dehydrodimerizing is carried out in a flow cell.

13. The process of claim 1, wherein a current density of from 1 to 1000 $mA/cm^2$ is employed in the dehydrodimerizing.

14. The process of claim 1, wherein the dehydrodimerizing is carried out at a temperature in a range from −20 to 60° C. and at atmospheric pressure.

15. The process of claim 1, wherein the at least one substituted aryl alcohol is 2,4-dimethylphenol.

16. The process of claim 1, wherein the at least one substituted aryl alcohol is polycyclic.

17. The process of claim 1, wherein trifluoroacetic acid is the at least one mediator.

18. The process of claim 1, wherein the mediator is the perfluorinated mediator.

19. The process of claim 1, wherein the at least one mediator is selected from the group consisting of a partially fluorinated acid and a perfluorinated acid.

* * * * *